US009528506B2

(12) United States Patent
Yoshida et al.

(10) Patent No.: US 9,528,506 B2
(45) Date of Patent: Dec. 27, 2016

(54) AIR COMPRESSOR

(75) Inventors: Tsutomu Yoshida, Tokyo (JP); Tomohiko Serita, Tokyo (JP)

(73) Assignee: MAX CO., LTD., Tokyo (JP)

( * ) Notice: Subject to any disclaimer, the term of this patent is extended or adjusted under 35 U.S.C. 154(b) by 2001 days.

(21) Appl. No.: 11/794,303

(22) PCT Filed: Dec. 22, 2005

(86) PCT No.: PCT/JP2005/023672

§ 371 (c)(1),
(2), (4) Date: Jun. 27, 2007

(87) PCT Pub. No.: WO2006/070703

PCT Pub. Date: Jul. 6, 2006

(65) Prior Publication Data

US 2008/0112823 A1 May 15, 2008

(30) Foreign Application Priority Data

Dec. 28, 2004 (JP) ..... 2004-381677

(51) Int. Cl.

| | |
|---|---|
| ***F04B 35/06*** | (2006.01) |
| ***F04B 41/02*** | (2006.01) |
| ***F04B 35/04*** | (2006.01) |
| ***F04B 39/06*** | (2006.01) |

(52) U.S. Cl.

CPC ..... *F04B 35/06* (2013.01); *F04B 35/04* (2013.01); *F04B 39/066* (2013.01); *F04B 41/02* (2013.01); *F04B 2203/0204* (2013.01)

(58) Field of Classification Search

USPC ..... 417/423.8, 410.1, 423.14

See application file for complete search history.

(56) References Cited

U.S. PATENT DOCUMENTS 5,497,289 A * 3/1996 Sugishima et al. ..... 361/709
6,320,776 B1 * 11/2001 Kajiura et al. ..... 363/141
6,808,372 B2 * 10/2004 Makino et al. ..... 417/410.5

(Continued)

FOREIGN PATENT DOCUMENTS

JP 58-32055 3/1983
JP 2000-283046 10/2000

(Continued)

OTHER PUBLICATIONS

JP2000283046A,machine translation.*

*Primary Examiner* — Devon Kramer
(74) *Attorney, Agent, or Firm* — Drinker Biddle & Reath LLP

(57) ABSTRACT

An inverter substrate in which heat generating components which make up an inverter control unit are mounted on a rear surface side thereof is accommodated in a case which is made of a material having a good thermal conductivity in such a manner that the heat generating components are closely contact with a base of the case. The case is provided between a pair of air tanks which are disposed parallel to each other at an interval and on a lower side of at least either of an electric motor and compressors in such a manner as to be oriented downwards so that the base is located at an upper position. An air flow generated by cooling fans which are driven by the electric motor is introduced to flow along the base of the case to thereby cool the heat generating components via the case.

13 Claims, 5 Drawing Sheets

(56) References Cited

U.S. PATENT DOCUMENTS

| | | | | |
|---|---|---|---|---|
| 6,822,353 | B2 * | 11/2004 | Koga et al. | 310/64 |
| 7,009,318 | B2 * | 3/2006 | Iritani et al. | 310/58 |
| 7,030,520 | B2 * | 4/2006 | Takenaka et al. | 310/64 |
| 7,122,928 | B2 * | 10/2006 | Shindo | 310/89 |
| 2004/0197213 | A1 * | 10/2004 | Takemoto | 417/410.1 |

FOREIGN PATENT DOCUMENTS

| | | | |
|---|---|---|---|
| JP | 2000283046 | A * | 10/2000 |
| JP | 2003-153552 | | 5/2003 |

* cited by examiner

AIR COMPRESSOR

TECHNICAL FIELD

The present invention relates to an air compressor including an electric motor controlled and driven via an inverter control unit, a compressor adapted to be driven by the electric motor and to generate compressed air, and an air tank for storing the compressed air generated by the compressor.

BACKGROUND ART

In general, an air compressor is made up of an electric motor which is driven to rotate by electric power supplied thereto, an air compressor which is driven by the electric motor to compress air sucked thereinto from the outside and discharge the compressed air and an air tank for storing the compressed air which is discharged from the compressor. JP-A-2000-283046 discloses an air compressor in which the supply of electric power to an electric motor which drives a compressor is implemented by an inverter control unit which functions to reduce consumed electric by driving the electric motor efficiently by detecting the rotational position of a rotor of the electric motor and controlling the supply of current and voltage to a coil of a stator of the electric motor by varying frequencies thereof according to detection outputs.

The inverter control unit is made up of an electric power supply module which is made up, in turn, of a semiconductor switching element for switching current and voltage supplied to the stator coil of the electric motor and other constituent components and a control module for controlling the electric power supply module based on detection signals of the rotational position of the rotor inside the electric motor. Since the semiconductor switching element making up the power supply module generates heat during its operation, the inverter control unit which includes the electric power supply module on which the semiconductor switching element is mounted and the control module is broken by virtue of heat generated by the semiconductor switching element, and this may lead to a problem that the control of the electric motor is disabled. In general, a protection circuit is formed on the circuit for cutting off the circuit to prevent the failure of the components when the temperatures of the components reach a predetermined temperature. In the air compressor, in the event that the compressing operation is stopped every time the protection circuit works, the operability is deteriorated. To cope with this, in an air compressor which utilizes an inverter control unit like this, it is necessary to cool, in particular, the semiconductor switching element of the electric power supply module in order to prevent the overheat of the inverter control circuit.

In order to facilitate the cooling of the semiconductor switching element itself, the semiconductor switching element of the electric power supply module is formed as an independent inverter module. In the air compressor which utilizes the inverter control unit disclosed in JP-A-2000-283046, this inverter module is separated from the electric power supply module so as to be mounted on a radiator plate, and the radiator plate on which the inverter module is mounted is provided between a pair of air tanks and on a lower side of the electric motor, so as to cool the inverter module by a flow of air that is generated by cooling fans mounted at both ends of the rotating shaft of the electric motor in order to cool the electric motor and the compressor.

In the air compressor disclosed in JP-A-2000-283046, the radiator plate on which the inverter module, which is the heat generating component, is mounted is disposed between the pair of air tanks, so as to cool the inverter module via the radiator plate by cooling air which cools the compressor and the electric motor. In order to cool the inverter module properly, it is necessary to prepare a radiator plate having a wide surface area, and it is also necessary to secure a space for installation of the radiator plate, and therefore, this configuration has constituted a cause for preventing the attempt to make the air compressor small in size and light in weight.

In addition, in the air compressor disclosed in JP-A-2000-283046, a circuit board of the electric power supply module which is made up of the other components excluding the inverter module, which is the heat generating component in an inverter circuit, is separated from the inverter module and is disposed between and below the pair of air tanks with its face turned up. In the event that the circuit board of the electric power supply module and the inverter module are disposed separately from each other in this way, wirings including an electric power supply wire, a signal wire and the like need to be provided therebetween, and this serves to increase the production cost of the substrates and manhours required in assembly of the compressor, leading to a problem that the production cost of the compressor is increased.

DISCLOSURE OF THE INVENTION

According to one or more embodiments of the invention, there is provided a cooling system for an air compressor which can cool the heat generating component on the inverter circuit board with good efficiency and can realize the reduction of size and weight, as well as production cost of the air compressor.

According to one or more embodiments of the invention, an air compressor is provided with an electric motor, a compressor mounted on a motor housing of the electric motor so as to be driven by the electric motor for generation of compressed air, a pair of air tanks for storing compressed air that is generated by the compressor which are each formed into an elongated barrel shape and are disposed in parallel to each other at an interval below the electric motor in such a manner that their longitudinal axes run substantially parallel to an axial direction of the electric motor, a substrate on which a heat generating component which makes up a control unit for the electric motor is mounted, a case for accommodating therein the substrate, and a cooling fan provided on a rotating shaft of the electric motor for generating cooling air which flows along the axial direction of the electric motor so as to cool the compressor, the electric motor and the heat generating component via the case, wherein the heat generating component is accommodated in such a manner as to be closely contact with a base of the case, and wherein the case is provided between the pair of air tanks and below at least either of the electric motor and the compressor in such a manner that the base thereof is located at an upper position.

In addition, according to one or more embodiments of the invention, the control unit of the electric motor is provided with a primary component which includes the heat generating component and a secondary component, the secondary component being mounted on a front surface or the substrate and the primary component being mounted on a rear surface of the substrate.

Additionally, according to one or more embodiments of the invention, the control unit of the electric motor is provided with an inverter control unit, and the substrate is an inverter control substrate.

In addition, according to one or more embodiments of the invention, the inverter control unit is provided with an inverter module and a circuit component for controlling the inverter module, the circuit component being mounted on a front surface of the inverter control substrate and the inverter module being mounted on a rear surface of the inverter control substrate, and the inverter control substrate is accommodated in the case in such a manner that a surface of the inverter module is closely contact with the base of the case.

Additionally, according to one or more embodiments of the invention, the inverter module includes a semiconductor switching element for supplying electric power to a stator coil of the electric motor, and the circuit component includes a capacitor.

In addition, according to one or more embodiments of the invention, the compressor is mounted at a longitudinal end of the motor housing.

Additionally, according to one or more embodiments of the invention, the case is made of a material with a good thermal conductivity.

In addition, according to one or more embodiments of the invention, the air compressor further includes a radiator plate provided on an external surface of the base of the case and made up of a plurality of cooling fins which extend substantially parallel to the rotating shaft of the electric motor.

Additionally, according to one or more embodiments of the invention, the radiator plate is mounted on the base of the case in such a manner as to be closely contact therewith.

In addition, according to one or more embodiments of the invention, the radiator plate is provided on the base of the case in such a manner as to be integrated into the case.

Additionally, the cooling fan includes a primary fan mounted at one end of the rotating shaft of the electric motor and a secondary fan mounted the other end of the rotating shaft of the electric motor.

According to the air compressor of the one or more embodiments of the invention, in the air compressor which is adapted to be driven via the electric motor which is controlled to be driven via the inverter control unit (the inverter control unit), the inverter substrate in which the heat generating components making up the inverter control unit is mounted on the rear surface side of the substrate is accommodated within the case made of the material with the good thermal conductivity in such a manner that the heat generating component is closely contact with the base of the case, the case is provided between the pair of air tanks and on the lower side of at least either of the electric motor and the compressor in such a manner as to be oriented downwards so that the base is located at the upper position, and the heat generating component of the inverter control unit is cooled via the case by introducing the air flow generated by the cooling fan along the base of the case. Because of this, the heat generating component is closely contact with the case which has the high thermal conductivity and the large surface area, and the case is cooled by the cooling fan. As a result, the heat generating component of the inverter control unit can be cooled with good efficiency by the cooling fan for cooling the compressor and the electric motor. In addition, since the heat generating component and the other component which make up the inverter control unit can be disposed on the integral inverter substrate, no wiring is necessary between the heat generating component and the other components which make up the inverter control unit, thereby making it possible to decrease the production costs. Furthermore, the electronic circuit board which makes up the inverter control unit is mounted in the case upside down, whereby a state is produced in which the case is allowed to lie over the electronic circuit board, thereby making it possible to eliminate a risk that an insulation failure is caused by dust and dirt which have built up on the circuit board or substrate to thereby cause a malfunction or operation failure. In addition, an insulation failure can also avoided which would results by water such as rain water dropping on to the substrate.

In addition, according to the one or more embodiments of the invention, on the base of the case which accommodates therein the inverter substrate, the radiator plate made up of the plurality of cooling fins which run substantially parallel to the rotating shaft of the electric motor is provided on the external surface of at least the portion to which the heat generating component is contact. Furthermore, as a result of this, the cooling of the heat generating component of the inverter control unit by the cooling fan can be performed with good efficiency.

Additionally, according to the one or more embodiments of the invention, the radiator plate is mounted in such a manner as to be closely contact with the base of the case. As a result of this, the radiator plate can easily be provided in any position on the base of the case which faces the radiator plate, thereby making it possible to perform the cooling of the heat generating component effectively.

Furthermore, according to the one or more embodiments of the invention, the radiator plate is provided on the base of the case in such a manner as to be integrated into the case. As a result of this, the cooling of the radiator plate and the heat generating component via the case can be performed effectively without damaging the thermal conductivity from the case to the radiator plate.

Other aspects and advantages of the invention will be apparent from the following description and the appended claims.

DESCRIPTION OF REFERENCE NUMERALS

Figure 1:
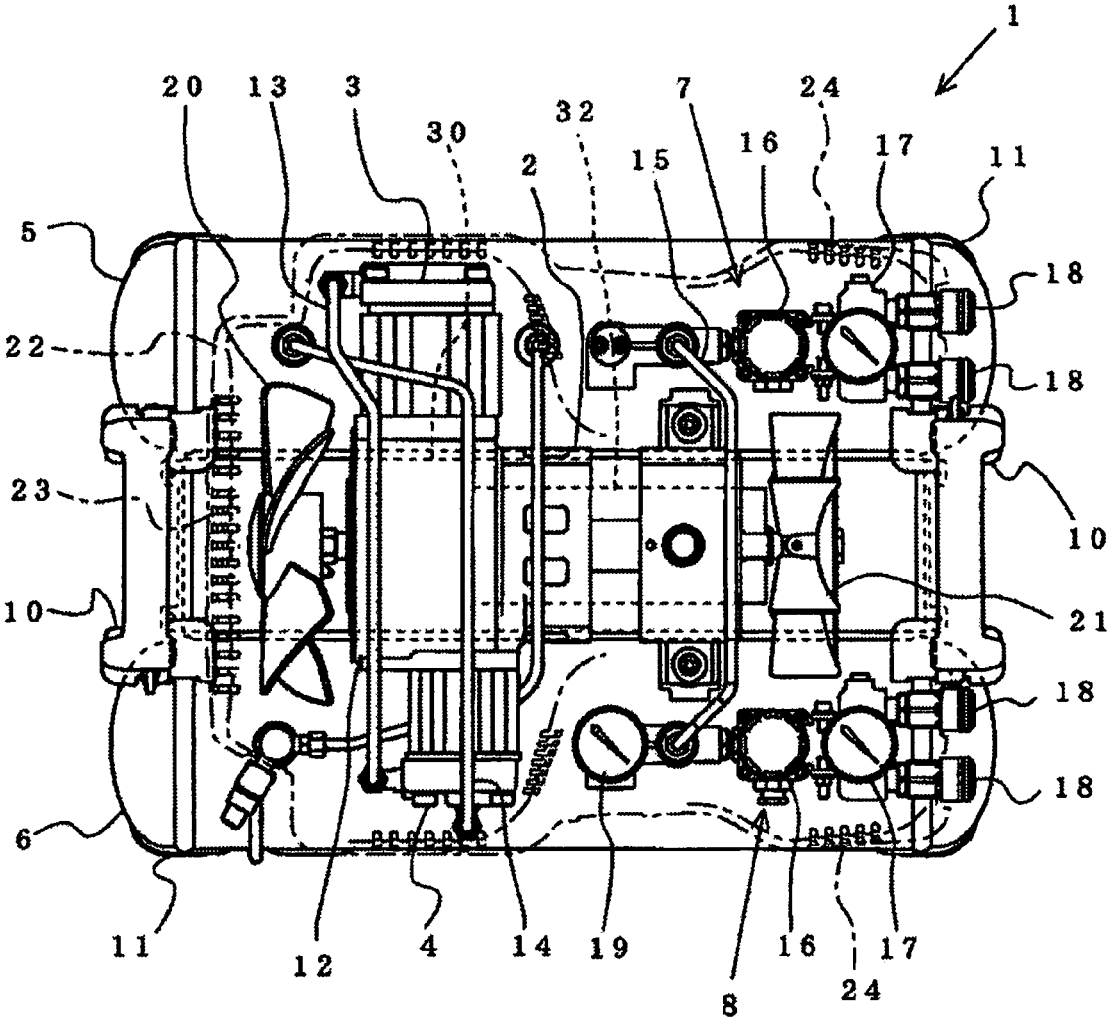
FIG. 1 A plan view of an air compressor with a cover removed.

1 air compressor
2 electric motor
3, 4 compressor
5, 6 air tank
9 inverter control unit (inverter control unit)
20, 21 cooling fan (primary fan, secondary fan)
26 inverter module (heat generating component, primary component)
28 inverter substrate
30 case

32 radiator plate
33 cooling fin

BEST MODE FOR CARRYING OUT THE INVENTION

Hereinafter, an embodiment of the invention will be described by reference to the drawings.

Embodiment 1

FIG. 1 shows an interior arrangement of primary constituent elements of an air compressor with a cover removed which is indicated by alternate long and short dash lines. An air compressor 1 includes an electric motor 2 which is driven to rotate by electric power supplied thereto, two compressors 3, 4 which are driven by virtue of the rotation of the electric motor 2 to thereby let in and compress outside air so as to generate compressed air, a pair of air tanks 5, 6 which are each formed into an elongated barrel shape for storing compressed air that is generated by the compressors 3, 4, compressed air outlet portions 7, 8 for reducing the pressure of compressed air stored in the air tanks 5, 6 to a predetermined pressure for supply to a pneumatic tool or the like and an inverter control unit 9 (shown in FIG. 2) for controlling the rotation of the electric motor.

The pair of air tanks 5, 6 is disposed so as to be aligned with each at an interval on a plane in such a manner that their longitudinal axes run substantially parallel to each other and are connected to a frame 10 which is welded between the air tanks 5, 6, and the air tanks 5, 6 are made to be placed on a floor or the like by resting legs 11 attached to respective lower surfaces of the air tanks. Furthermore, the electric motor 2 is disposed above the pair of air tanks 5, 6 in such a manner that a rotating shaft of the electric motor 2 runs substantially parallel to the longitudinal axes of the air tanks 5, 6. A crankcase 12 is formed integrally at one end of a motor housing for the electric motor 2, and furthermore, the two compressors 3, 4 are also mounted on the crankcase 12 which are adapted to let in outside air to produce highly pressurized compressed air.

These two compressors 3, 4 constitute a two-stage compressor, in which a first-stage compressor 3 and a second-stage compressor 4 are mounted, respectively, on both side surfaces of the crankcase 12 in such a manner as to face each other substantially in a horizontal direction. The first-stage compressor 3 sucks in outside air by way of the interior of the crankcase 12 to compress it to an intermediate pressure and then supply the air so compressed to the second-stage compressor 4 by way of a primary discharge pipe 13. The second-stage compressor 4 compresses the compressed air which was compressed to the intermediate pressure and has now been supplied thereto by way of the primary discharge pipe 13 by the first-stage compressor 3 to a high pressure region and then supplies the compressed air so compressed to one of the air tanks or the air tank 5 by way of a secondary discharge pipe 14. The two air tanks 5, 6 are configured such that interiors thereof are made to communicate with each other via a communication pipe 15, whereby compressed air supplied into the air tank 5 flows through the communication pipe 15 to flow into the other air tank 6, so that pressures inside both the air tanks 5, 6 are maintained at the same pressure.

The compressed air outlet portions 7, 8 for letting out compressed air inside the air tanks 5, 6 to pneumatic tools therefrom are provided on the air tanks 5, 6, respectively. The compressed air outlet portions 7, 8 are each made up of a pressure reducing valve 16 for reducing the pressure of the compressed air stored in the respective air tanks 5, 6 to any suitable pressure for use on a pneumatic tool, a secondary air pressure indicator 17 for indicating the pressure of the compressed air whose pressure is reduced by the pressure reducing valve 16 and socket portions 18 each adapted to connect to a plug which is connected to one end of an air hose which is connected to a pneumatic tool or the like at the other end. Note that in this embodiment, two socket portions 18 are formed on each of the compressed air outlet portions 7, 8 so that compressed air can be simultaneously supplied to two tools or the like from the compressed air outlet portions 7, 8, respectively. In addition, a primary pressure indicator 19 is provided on one of the compressed air outlet portions or the compressed air outlet portion 8 for indicating the pressure value of the compressed air stored in the air tanks 5, 6.

Figure 2:
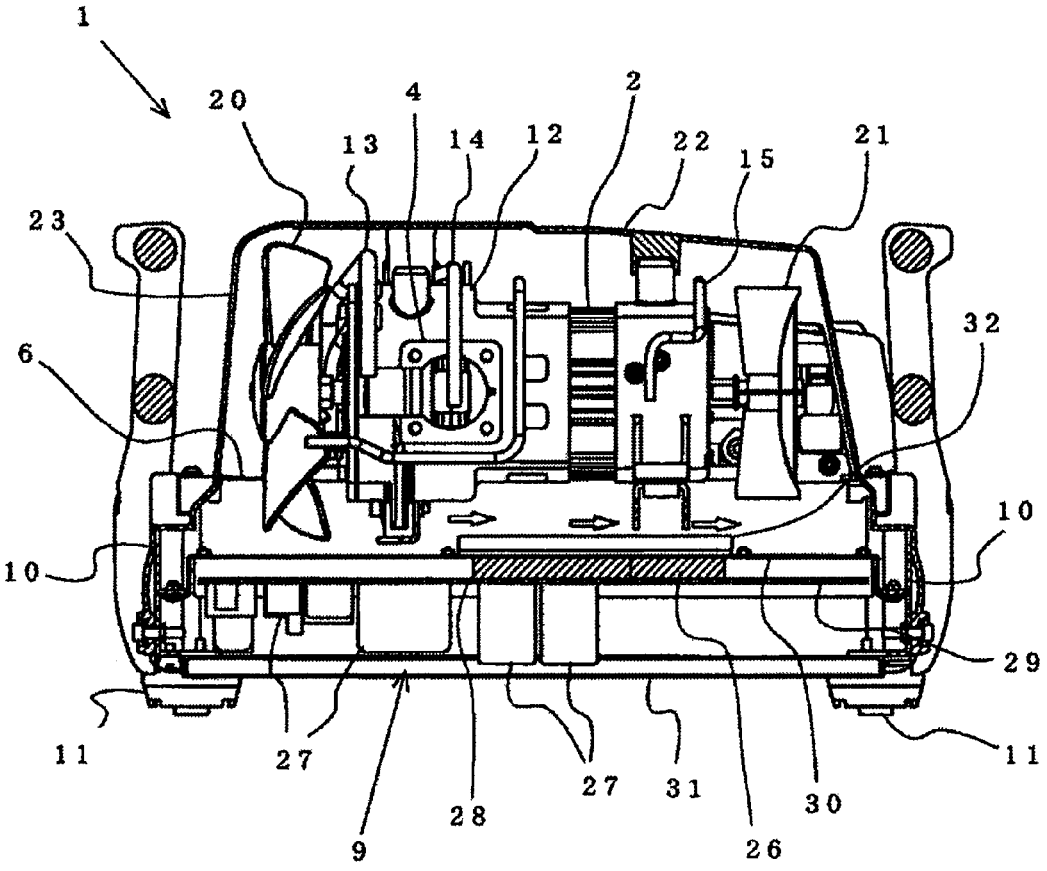
FIG. 2 A partially sectional side view of the air compressor shown in FIG. 1.

As is shown in FIGS. 1 and 2, cooling fans 20, 21 are mounted at both ends of the rotating shaft of the electric motor 2, respectively. The cooling fans 20, 21 constitute, respectively, a primary fan 20 which is provided at one end of the rotating shaft and a secondary fan 21 which is provided at the other end of the rotating shaft of the electric motor 2. Cooling air is generated by the cooling fans 20, 21 by virtue of the rotation of the electric motor 2 so as to cool the compressors 3, 4 and the electric motor 2. The cooling fan 20, which is mounted at an end portion the rotating shaft located on one side of the electric motor 2 which projects from an end portion of the crankcase 12 on which the compressors 3, 4 are mounted, is made up of an axial fan and is made to suck outside air into the interior of a cover 22 from openings 23 formed in the cover 22 in such a way for the air to flow along outer circumferential surfaces of the compressors 3, 4 and the motor housing of the electric motor 2, so as to cool the compressors 3, 4 and the electric motor 2 with the cooling air so flowing. In addition, the cooling fan 21, which is mounted at an end portion of the rotating shaft located on the other side of the electric motor 2, is made up of a sirocco fan and is made to suck out the air inside the motor housing from an end portion of the motor housing to discharge it to the outside of the cover 22 via openings 24 formed in the cover 22 to thereby generate an air flow inside the motor housing to cool a winding portion of the electric motor.

The electric motor 2 is designed to be controlled to rotate by detecting the rotational position of a rotor of the electric motor 2 by a detection unit such as a Hall element and inverter controlling the supply of electric power to a stator coil of the electric motor 2 based on a detection output from the detection unit. The electric motor 2 is connected to an external power supply via the inverter control unit 9 (a control circuit for the electric motor, an inverter control circuit) and is designed to be controlled to rotate by electric power supplied to the stator coil via the inverter control unit 9. As is shown in FIGS. 2 and 3, the inverter control unit 9 is made up of inverter modules 26 (a heat generating component, a primary component) which are made up, in turn, of semiconductor switching elements for supply electric power to the stator coil of the electric motor 2, circuit components 27 (a secondary component) which are components other than the inverter modules 26 such as capacitors for controlling the inverter modules 26, an inverter substrate 28 on which the inverter modules 26 and the circuit components 27 are mounted and a control substrate 29 which is made up of a component mounted thereon for controlling the inverter substrate 28.

Figure 4:
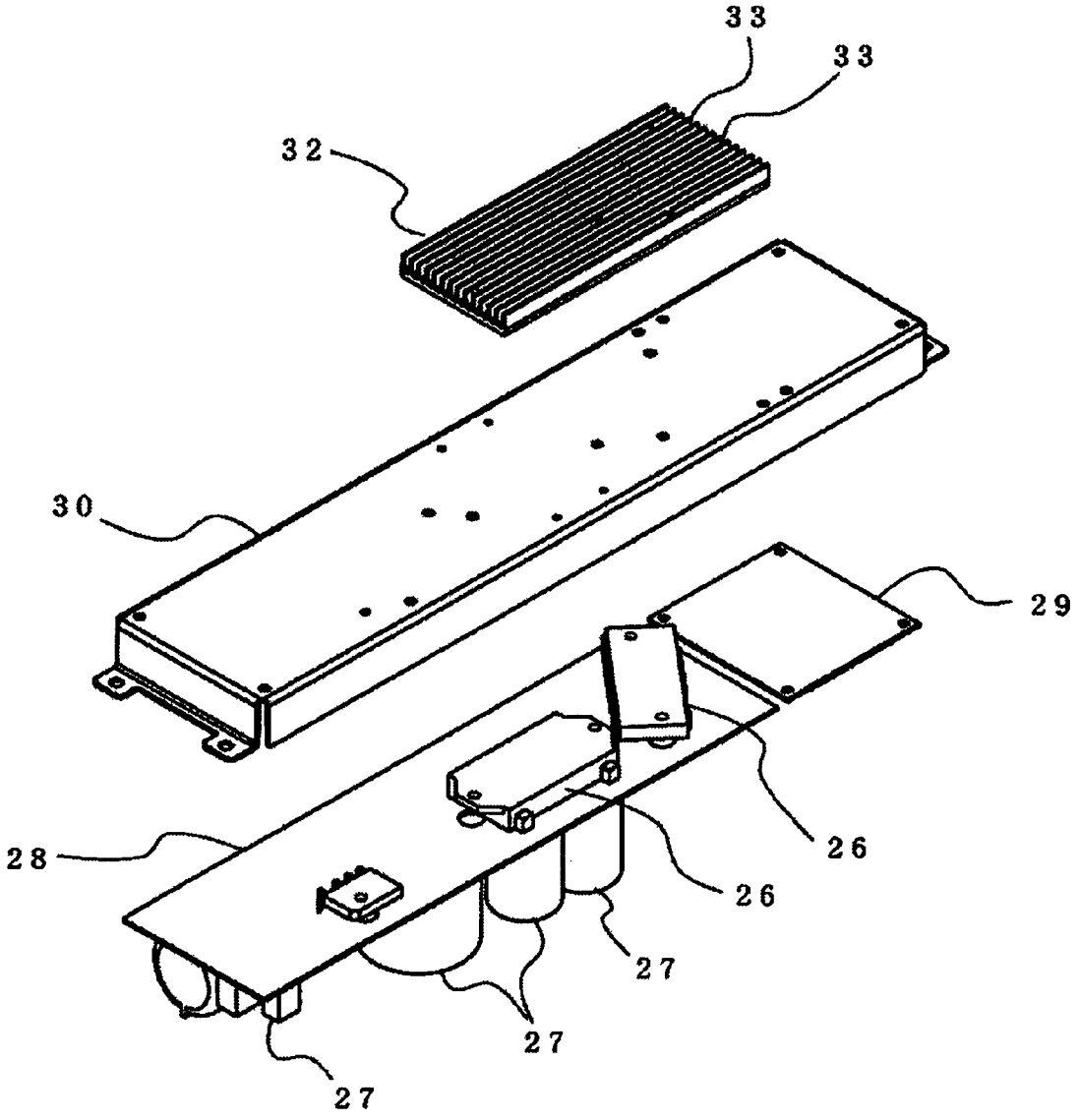
FIG. 4 A perspective view which shows an inverter substrate, a case which accommodates therein the inverter substrate, and a radiator plate.

Among the components making up the inverter control unit 9, the inverter modules 26 constitute heat generating components which have a largest heat value, and as is shown in FIG. 4, the inverter modules 26 are mounted on a rear surface side of the inverter substrate 28 which constitutes an opposite surface to a surface of the inverter substrate 28 on which the circuit components 27 such as capacitors other than the inverter modules 26 are mounted in such a manner that metallic surfaces which are formed to be exposed on surfaces of the inverter modules 26 are oriented upwards as viewed in the figure. Note that while in this embodiment, the control substrate 29 for controlling the inverter substrate 28 is formed separately from the inverter substrate 28, the control substrate 29 may be configured so as to be integrated with the inverter substrate 28. No winding is necessary between both the substrates 28, 29 by the configuration in which the two substrates are integrated with each other in this way, thereby making is possible to reduce further the production costs.

Figure 3:
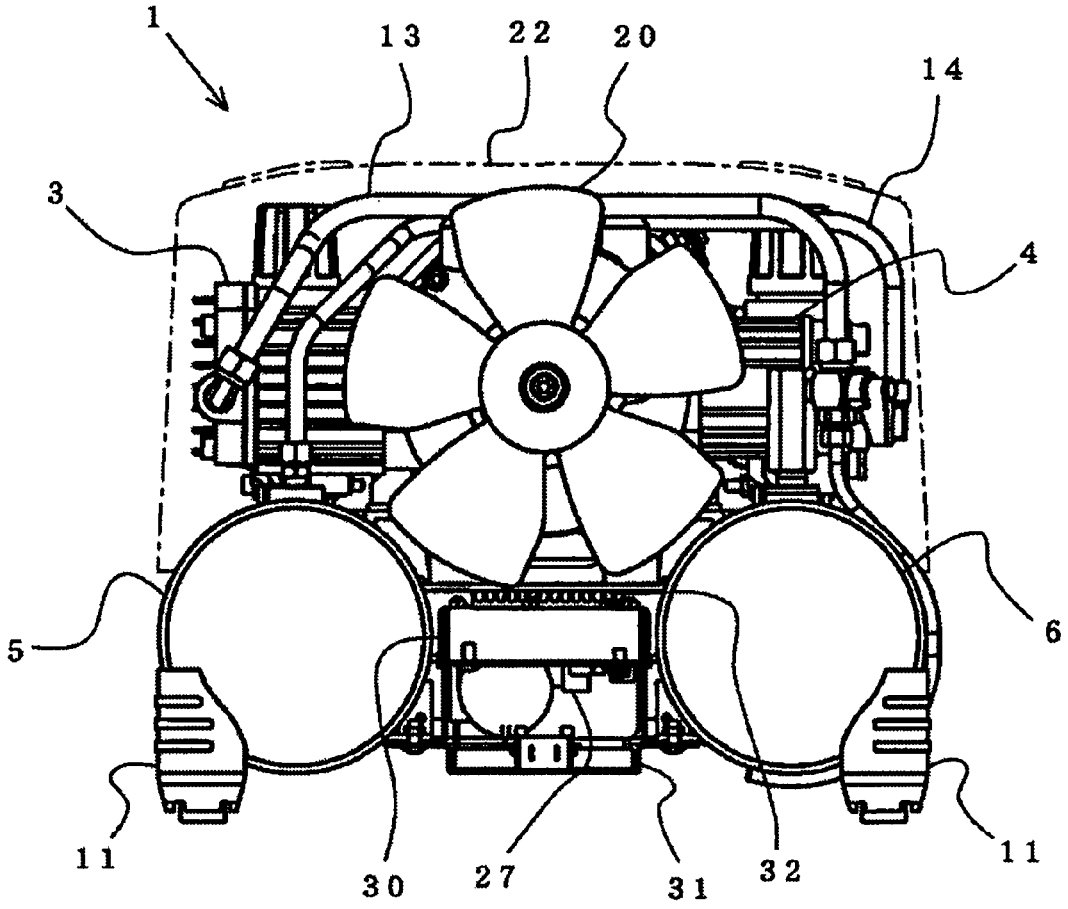
FIG. 3 A front view of the air compressor shown in FIG. 1 with the cover removed.
Figure 5:
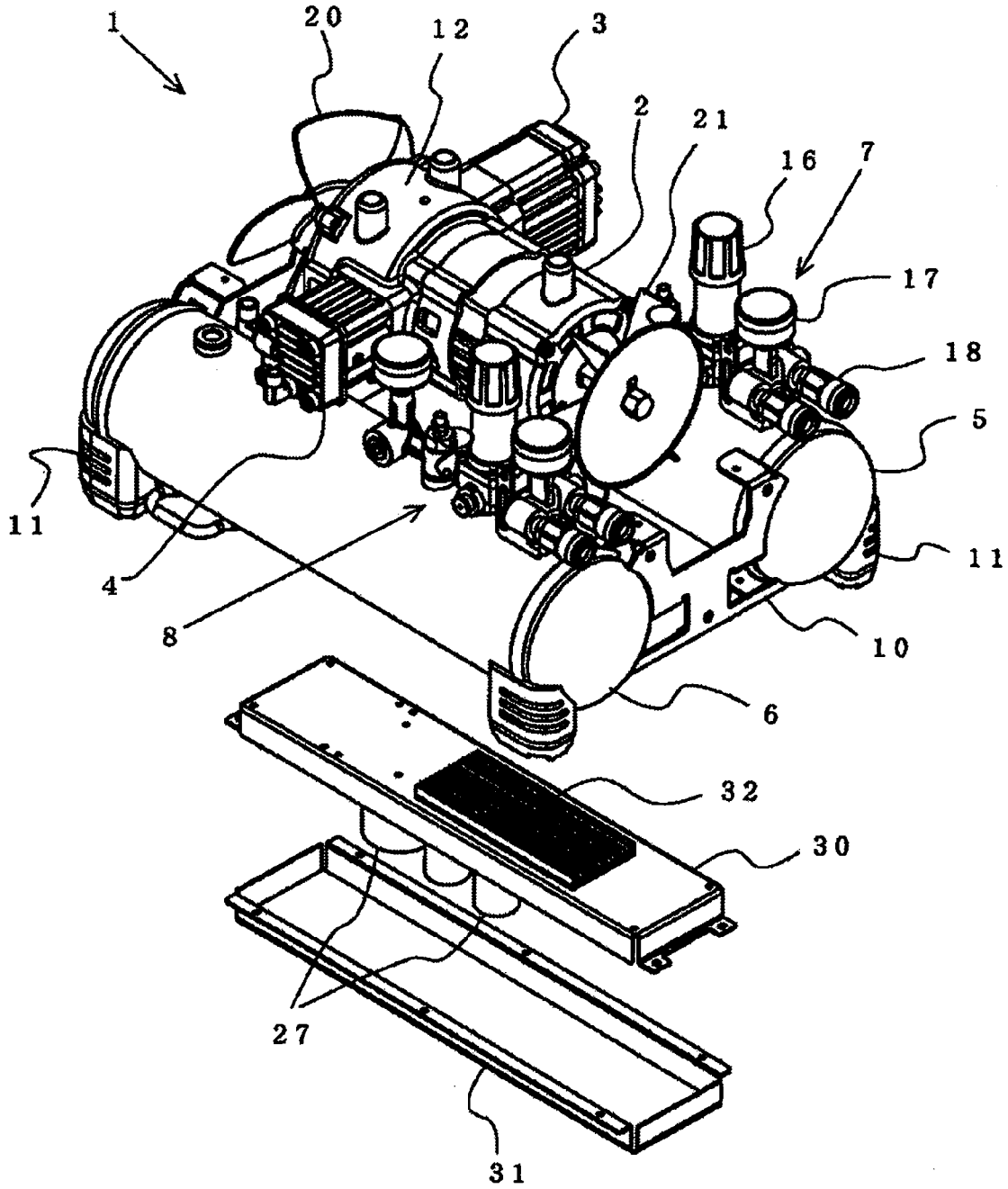
FIG. 5 A perspective view which shows a state in which the case which accommodates the inverter substrate and the cover are assembled on to the air compressor.

As is shown in FIGS. 2 and 3, a case 30, which is formed of, for example, aluminum having a high thermal conductivity into a box shape for accommodating therein the inverter substrate 28 and the control substrate 29, is mounted in a space between the pair of air tanks 5, 6 in such a manner that an opening is oriented downwards so that a base is located at an upper position. This case 30 is disposed substantially horizontally in the space between the air tanks 5, 6, and cooling air generated by the cooling fans 20, 21 is made to flow along an external surface of the base of the case 30. In addition, the inverter substrate 28, which makes up the inverter control unit 9, is accommodated in the case 30 in such a manner that the surface of the inverter substrate 28 on which the inverter modules 26 are mounted faces the base of the case so that the metallic surfaces formed on the surfaces of the inverter modules 26 are closely contact with the base of the case 30. Furthermore, as is shown in FIGS. 2, 3 and 5, a cover 31 is mounted on a lower side of the inverter substrate 28 so as to protect the lower side of the substrate.

As has been described heretofore, since the inverter modules 26, which have the largest heat value among the components making up the inverter control unit 9, are mounted on the rear surface side of the substrate in such a manner that the inverter modules 26 are closely contact with the case 30 which is made of the metal having the high thermal conductivity and which has the wide surface area, the inverter modules 26 can be cooled with good efficiency by cooling air which flows along the external surface of the case 30 having the broad surface area, thereby making it possible to prevent the thermal failure of the inverter modules 26 and the other components.

Furthermore, a radiator plate 32 made up of a number of cooling fins 33 which are formed in such a manner as to run substantially parallel to the rotating shaft of the electric motor 2 is mounted on the external surface of the case 30 in such a manner that a rear surface of the radiator plate 32 is closely contact with the external surface of the base of the case, whereby the cooling efficiency of the inverter modules 26 by the cooling air generated by the cooling fans 20, 21 via the case can be increased further.

In addition, the inverter modules 26 are mounted on the rear surface side of the inverter substrate 28, and the inverter substrate 28 is accommodated in the case 30 in such a state that the side of the inverter substrate 28 on which the components other than the inverter modules 26 are mounted is oriented downwards, whereby a problem can be prevented that dust or the like which would otherwise intrude into the case 30 from a gap or gaps between the case 30 and the inverter substrate 28 builds up on the substrate and an insulation failure between the components is caused by the dust to cause, in turn, an operation failure or a malfunction. Furthermore, a problem can also be avoided that water such as rain water drops on to the substrate to cause an insulation failure. In addition, since wires which are connected to various connectors, not shown, provided on the substrate are provided in such a manner as to extend towards the substrate from the lower side of the substrate, a problem can be prevented that water is carried along the wires to the various connectors.

While in the description of the embodiment, the two compressors 3, 4 are provided on the crankcase which is formed integrally at the one end of the electric motor in such a manner as to face horizontally with each other across the crankcase so as to make up the two-stage compressor for generating compressed air which is compressed to the high pressure region in two stages, the invention is not limited thereto, and hence, the air compressor may be configured into an air compressor in which such compression is carried out in one stage or three or more stages. Furthermore, the arrangement of the compressors 3, 4 is not limited to the horizontally facing arrangement, and hence, an arrangement may be adopted in which a plurality of compressors are arranged in parallel to one another or in a V-shape. In addition, while the inverter modules 26 are described as an example of the heat generating component, the invention is not limited thereto, and hence, the invention can be applied to various types of heat generating components including rectifier diode elements, motor driving power supply modules and the like.

While the invention has been described in detail and by reference to the specific embodiment, it is obvious to those skilled in the art that the invention can be changed or modified variously without departing from the spirit and scope of the invention.

The invention is based on the Japanese Patent Application (No. 2004-381677) filed on Dec. 28, 2004 and the contents thereof are incorporated herein by reference.

INDUSTRIAL APPLICABILITY

The air compressor of the invention can cool the heat generating components on the inverter circuit board which makes up the inverter control unit with good efficiency and, furthermore, can realize the reduction of size, weight and production costs of the air compressor.

The invention claimed is:

1. An air compressor comprising:

an electric motor;

a compressor adapted to be driven by the electric motor for generating compressed air;

a pair of air tanks adapted to store the compressed air generated by the compressor, each formed into an elongated barrel shape, and disposed parallel to each other at an interval;

an inverter control substrate on which an inverter module that makes up a control unit for the electric motor is mounted;

a case for accommodating the inverter control substrate therein;

a cooling fan adapted to generate cooling air so as to cool the compressor, the electric motor and the inverter module via the case; and a second cooling fan, wherein the inverter module is interposed between the inverter control substrate and a base of the case, the inverter module is mounted on an upper side of the inverter control substrate, and the base of the case positions on an upper side of the inverter module, wherein a surface of the inverter module is in directly close contact with the base of the case, wherein the base of the case extends substantially horizontally, wherein the inverter control substrate is parallel to the base of the case wherein the case is formed into a box shape so that an entirety of the inverter control substrate is accommodated therein, wherein the base of the case extends substantially in parallel to a flowing direction of the cooling air so that the cooling air flows along an external surface of the base serving as a cooling surface, wherein the cooling fan is mounted at one end of the electric motor and the second cooling fan is mounted at the other end of the electric motor, and wherein the base of the case extends horizontally from the cooling fan to the second cooling fan.

2. The air compressor according to claim 1, wherein the control unit of the electric motor comprises a primary component including the inverter module and a secondary component, the secondary component is mounted on a lower surface of the inverter control substrate, and the primary component is mounted on an upper surface of the substrate.

3. The air compressor according to claim 1, wherein the control unit comprises the inverter module and a circuit component for controlling the inverter module, and the circuit component is mounted on a lower surface of the inverter control substrate.

4. The air compressor according to claim 3, wherein the inverter module comprises a semiconductor switching element for supplying electric power to a stator coil of the electric motor, and the circuit component comprises a capacitor.

5. The air compressor according to claim 1, wherein the compressor is mounted at a longitudinal end of a motor housing.

6. The air compressor according to claim 1, wherein the case is made of a material with a good thermal conductivity.

7. The air compressor according to claim 1, further comprising a radiator plate provided on an external surface of the base of the case and formed with a plurality of cooling fins extending substantially parallel to a rotating shaft of the electric motor.

8. The air compressor according to claim 7, wherein the radiator plate is mounted on an upper side of the base of the case in such a manner as to be in close contact with the base of the case.

9. The air compressor according to claim 7, wherein the radiator plate is provided on an upper side of the base of the case in such a manner as to be integrated with the case.

10. The air compressor according to claim 1, wherein the case has a generally planar, broad surface area with a dimension that extends at least a longitudinal length of the electric motor.

11. The air compressor according to claim 1, wherein a gap is provided between the base of the case and the electric motor.

12. The air compressor according to claim 1, wherein the cooling fan is mounted at one end of a rotating shaft of the electric motor and the second cooling fan is mounted at another end of the rotating shaft of the electric motor.

13. The air compressor according to claim 12, wherein upper surfaces of the base at an upstream end and a downstream end are located underneath the cooling fan and the second cooling fan, respectively.

* * * * *